US009583881B2

(12) United States Patent
Yan et al.

(10) Patent No.: US 9,583,881 B2
(45) Date of Patent: Feb. 28, 2017

(54) ELECTRICAL CONNECTOR

(71) Applicant: Tyco Electronics (Shanghai) Co. Ltd., Shanghai (CN)

(72) Inventors: Hailong Yan, Shanghai (CN); Hui Wang, Shanghai (CN); Kai Hong, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 15/041,195

(22) Filed: Feb. 11, 2016

(65) Prior Publication Data

US 2016/0240978 A1 Aug. 18, 2016

(30) Foreign Application Priority Data

Feb. 15, 2015 (CN) ..... 2015 1 0084065

(51) Int. Cl.

*H01R 13/648* (2006.01)
*H01R 13/6471* (2011.01)
*H01R 12/58* (2011.01)
*H01R 13/6585* (2011.01)

(52) U.S. Cl.

CPC ..... *H01R 13/6471* (2013.01); *H01R 12/585* (2013.01); *H01R 13/6585* (2013.01)

(58) Field of Classification Search

CPC ..... H01R 13/6471; H01R 12/585; H01R 13/6585

USPC ..... 439/676, 660, 607.31, 787, 439, 441, 439/440, 181, 607.32, 260, 495, 912, 439/885, 607.11, 607.1, 607.07, 607.09, 439/79, 80, 933

See application file for complete search history.

(56) References Cited

U.S. PATENT DOCUMENTS 5,810,623 A * 9/1998 Regnier ..... H01R 12/721 439/637
6,139,377 A * 10/2000 Chen ..... H01R 43/16 439/885
6,435,913 B1 * 8/2002 Billman ..... H01R 23/688 439/107
6,638,111 B1 * 10/2003 McDaid ..... H01R 12/724 439/108
6,645,010 B1 * 11/2003 Billman ..... H01R 13/6587 439/108
6,719,587 B2 * 4/2004 Droesbeke ..... H01R 13/6589 439/607.1
7,094,102 B2 * 8/2006 Cohen ..... H05K 1/14 439/607.08

(Continued)

*Primary Examiner* — Abdullah Riyami
*Assistant Examiner* — Nelson R Burgos-Guntin
(74) *Attorney, Agent, or Firm* — Barley Snyder

(57) ABSTRACT

An electrical connector is provided and includes an insulating body, a plurality of signal terminals, and a plurality of ground terminals. The insulating body includes a slot extending therein. The signal terminals are positioned in the insulating body and configured in pairs along a width of the slot to form a plurality of signal terminal units. Each signal terminal unit includes a pair of signal contact portions positioned opposite each other with respect to the slot and a pair of signal terminal pins positioned opposite the pair of signal contact portions. The ground terminals are positioned in the insulating body and configured in pairs along the width of the slot as a plurality of ground terminal units. Each ground terminal unit includes a pair of ground contact portions located on opposite sides of the slot and arranged sequentially in alternation with the pair of signal contact portions along a length of the slot.

16 Claims, 6 Drawing Sheets

(56) References Cited

U.S. PATENT DOCUMENTS 7,108,521 B2 * 9/2006 Watanabe ..... H01R 12/58 439/82
7,722,399 B2 * 5/2010 Scherer ..... H01R 23/688 439/607.05
7,811,130 B2 * 10/2010 Cohen ..... H05K 1/14 439/607.1
8,764,483 B2 * 7/2014 Ellison ..... H01R 12/724 439/607.07
8,771,027 B2 * 7/2014 Zhang ..... H01R 4/4809 439/835
2002/0022401 A1 * 2/2002 Ramey ..... H01R 13/6585 439/607.1
2002/0031945 A1 * 3/2002 Schroll ..... H01R 13/6585 439/607.1
2003/0092320 A1 * 5/2003 Evans ..... H01R 12/728 439/607.1
2003/0216087 A1 * 11/2003 Pan ..... H01R 12/716 439/885
2004/0097134 A1 * 5/2004 Zaderej ..... H01R 13/6599 439/607.36
2005/0026474 A1 * 2/2005 Li ..... H01R 12/724 439/79
2011/0256780 A1 * 10/2011 Peng ..... H01R 12/55 439/676
2012/0115371 A1 * 5/2012 Chuang ..... H01R 12/724 439/660
2013/0017733 A1 * 1/2013 Kirk ..... H01R 12/724 439/676
2014/0213124 A1 * 7/2014 Wu ..... H01R 13/05 439/885
2014/0273651 A1 * 9/2014 Pao ..... H01R 13/6461 439/660
2015/0111401 A1 * 4/2015 Guo ..... H01R 13/6596 439/95
2015/0155665 A1 * 6/2015 Su ..... H01R 13/6477 439/676
2016/0036165 A1 * 2/2016 Phillips ..... H01R 13/6461 439/607.05

* cited by examiner

ELECTRICAL CONNECTOR

CROSS-REFERENCE TO RELATED APPLICATIONS

This application claims the benefit of the filing date under 35 U.S.C. §119 (a)-(d) of Chinese Patent Application No. 201510084065.3 filed on Feb. 15, 2015.

FIELD OF THE INVENTION

The invention relates to an electrical connector and, more particularly, to an electrical connector having a plurality of signal and ground terminals.

BACKGROUND

Micro Telecom Computing Architecture (uTCA) electrical connectors are known in the art and generally include an insulating body, and a plurality of signal terminals and a plurality of ground terminals secured in the insulating body. Electrical contact portions of the plurality of ground terminals are arranged on both sides of a slot of the insulating body along a width thereof, respectively, and are sequentially in alternate position with electrical contact portions of the signal terminals that is positioned along a length direction of the slot. For instance, the electrical contact portions of every two signal terminals are spaced apart by the electrical contact portion of one ground terminal.

As disclosed, the ground terminals are electrically insulated from each other. Ion known uTCA electrical connectors, the ground terminals are electrically isolated from one another; in other words, grounded shield fails to exist in both the length and the width of the electrical connector. Therefore, the signal shielding effect of the electrical connector is diminished so that more serious signal crosstalk exists within the low frequency domain of the signal terminals during the transmission of high-speed signal by the electrical connector, resulting in poorer signal integrity and insufficient performance for meeting either clients' demands or the requirements of related technical specifications.

SUMMARY

The invention has been made to overcome or alleviate at least one aspect of the above mentioned disadvantages and/or shortcomings.

It would be advantageous to provide an electrical connector which is capable of eliminating low frequency resonance point, decreasing signal crosstalk, and enhancing signal integrity so as to meet both the clients' demands and the requirements of related technical specifications.

An electrical connector is provided and includes an insulating body, a plurality of signal terminals, and a plurality of ground terminals. The insulating body includes a slot extending therein. The signal terminals are positioned in the insulating body and configured in pairs along a width of the slot to form a plurality of signal terminal units. Each signal terminal unit includes a pair of signal contact portions positioned opposite each other with respect to the slot and a pair of signal terminal pins positioned opposite the pair of signal contact portions. The ground terminals are positioned in the insulating body and configured in pairs along the width of the slot as a plurality of ground terminal units. Each ground terminal unit includes a pair of ground contact portions located on opposite sides of the slot and arranged sequentially in alternation with the pair of signal contact portions along a length of the slot.

BRIEF DESCRIPTION OF THE DRAWINGS

The above and other features and advantages of the invention will become more apparent and a more comprehensive understanding of the invention can be obtained, by describing in detail exemplary embodiments thereof with reference to the accompanying drawings, in which.

DETAILED DESCRIPTION OF THE EMBODIMENT(S)

Figure 1:
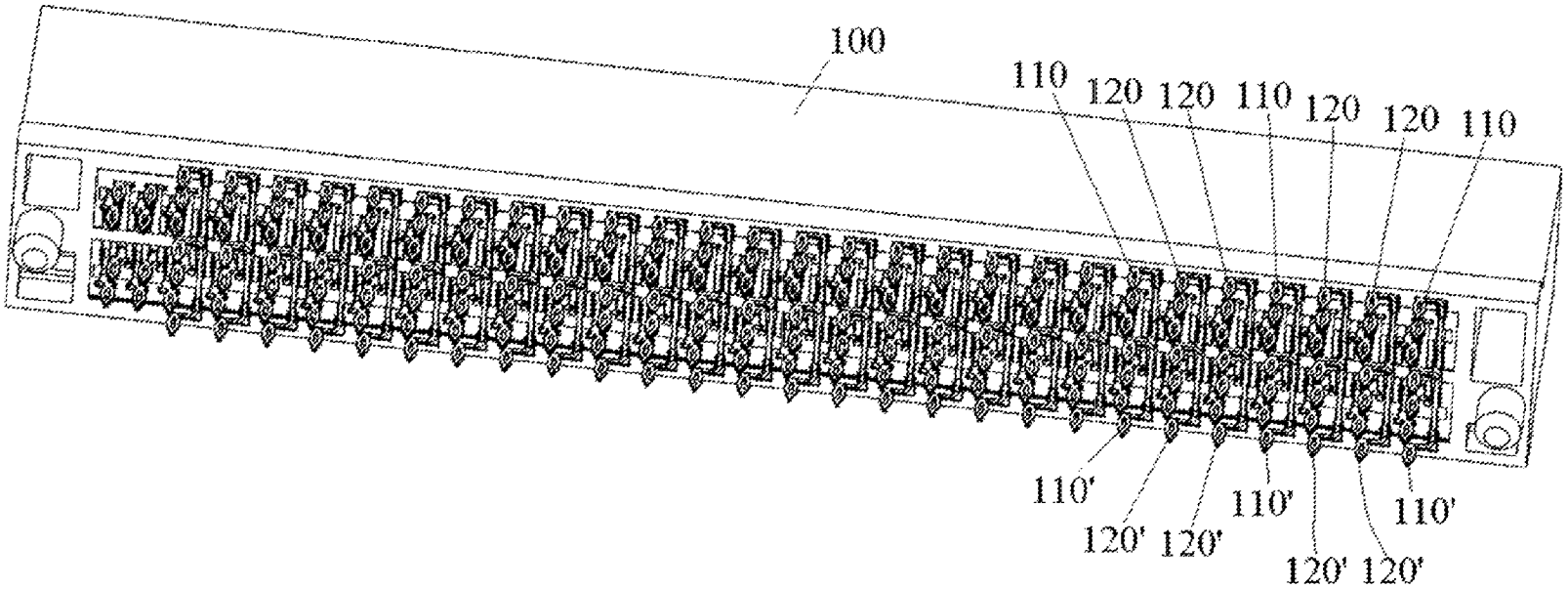
FIG. 1 is a perspective view of an electrical connector according to the invention.

Exemplary embodiments of the present disclosure will be described hereinafter in detail with reference to the attached drawings, wherein the like reference numerals refer to the like elements. The present disclosure may, however, be embodied in many different forms, and thus the detailed description of the embodiment of the invention in view of attached drawings should not be construed as being limited to the embodiment set forth herein; rather, these embodiments are provided so that the present disclosure will be thorough and complete, and will fully convey the general concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

With respect to FIG. 1, an electrical connector according to the invention is shown.

Figure 2:
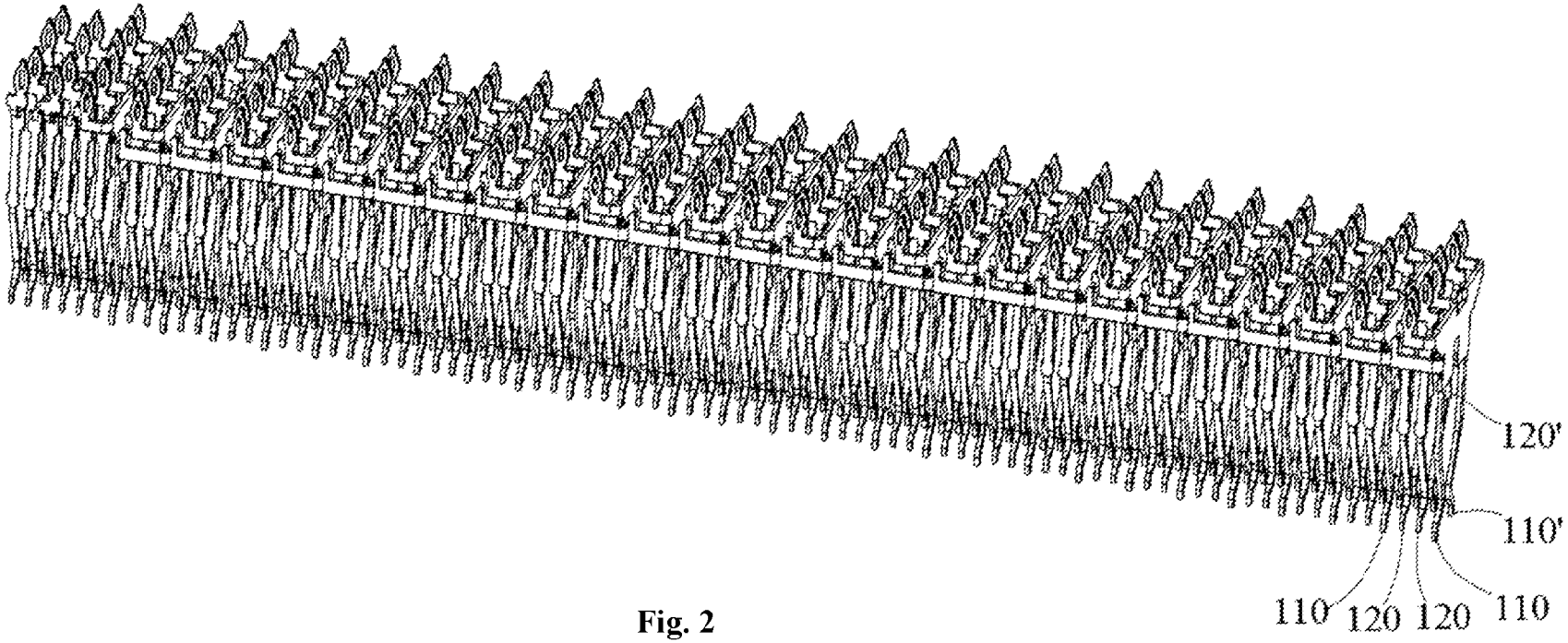
FIG. 2 is a perspective view of a plurality of signal terminals and a plurality of ground terminals of the electrical connector of FIG. 1.

As can be seen from FIGS. 1 and 2, the electrical connector generally includes an insulating body 100, a plurality of signal terminals 120, 120,' and a plurality of ground terminals 110, 110'. Both the signal terminals 120, 120' and the ground terminals 110, 110' are secured in the insulating body 100.

As shown in FIGS. 1-4, in an exemplary embodiment of the invention, the insulating body 100 includes a slot adapted to insert an electronic card module therein. A plurality of signal terminals 120, 120' are held in the insulating body 100, and each signal terminal 120, 120' includes an electrical contact portion 122, 122' and a signal terminal pin 121, 121'. The electrical contact portions 122, 122' of the plurality of signal terminals 120, 120' are located on both sides of the slot along a width of the slot. A plurality of ground terminals 110, 110' are held in the insulating body 100, and each ground terminal 110, 110' includes an electrical contact portion 112, 112' and a ground terminal pin 111, 111'. The electrical contact portions 112, 112' of the plurality of ground terminals 110, 110' are located on both sides of the slot along the width of the slot, respectively, and are arranged sequentially in alternation with the electrical contact portions 122, 122' of the signal terminals 120, 120' along a length of the slot. The electrical contact portions 122, 122' of every two signal terminals are spaced apart by the electrical contact portion 112, 112' of one ground terminal 110, 110'.

In the embodiment shown in FIGS. 1-4, the plurality of ground terminals 110, 110' are configured in pairs along the width of the slot. Each pair of ground terminals 110, 110' are integrally interconnected as one ground terminal unit 10, and two adjacent ground terminal units 10 are in electrical contact with each other. Thereby, the plurality of ground terminals 110, 110' are electrically interconnected there among along a length of the slot; thus effective electrical shields may be formed in both the length and the width such that the signal shielding effect of the electrical connector is enhanced. With such electrical connector of above configuration, low frequency resonance points may be eliminated effectively, with the signal crosstalk being decreased and the signal integrity being improved, simultaneously, so as to meet both clients' demands and the requirements of related technical specifications.

With reference to FIGS. 1-4, in an exemplary embodiment of the invention, each ground terminal unit 10 includes a pair of extension arms 132, 132' located on both sides of the slot in the width direction, respectively, and extending along the length of the slot. And as can be seen from FIG. 3, the pair of extension arms 132, 132' of one of two adjacent ground terminal units 10 is in electrical contact with those of the other of the two adjacent ground terminal units 10.

As shown in FIGS. 1-4, in the shown embodiment, a pair of ground terminals 110, 110' of each ground terminal unit 10 are interconnected with each other as a whole using an intermediate body portion 130 extending in the width direction of the slot. In the shown embodiment, the intermediate body portion 130 is in the form of plate shape. And the pair of ground terminals 110, 110' of each ground terminal unit 10 are connected with the pair of extension arms 132, 132' as an integral by the intermediate body portion 130, so that the pair of ground terminals 110, 110', the pair of extension arms 132, 132' and the intermediate body portion 130 may be formed by folding a single sheet of material.

Figure 3:
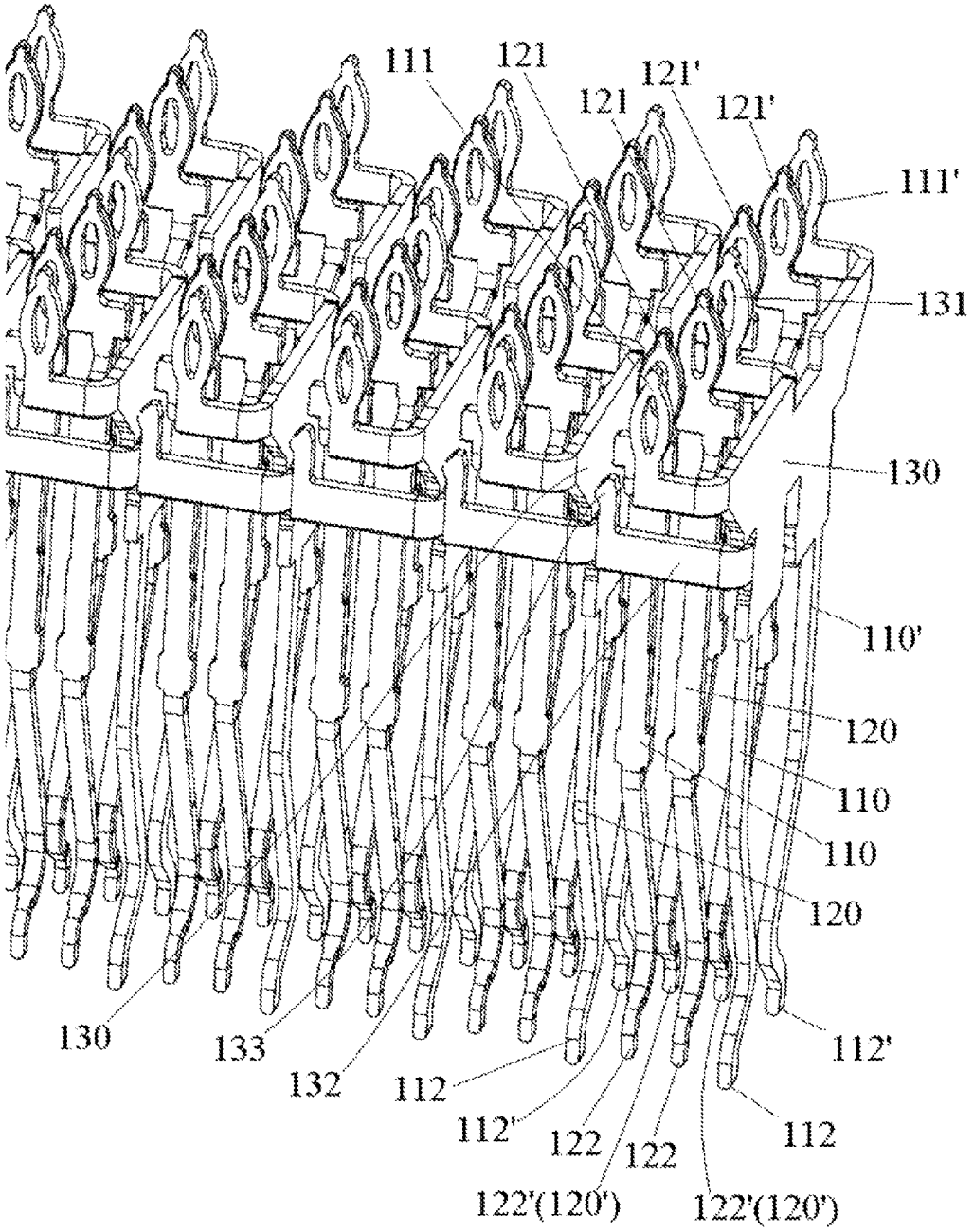
FIG. 3 is an enlarged view of the plurality of signal terminals and the plurality of ground terminals of FIG. 2.
Figure 4:
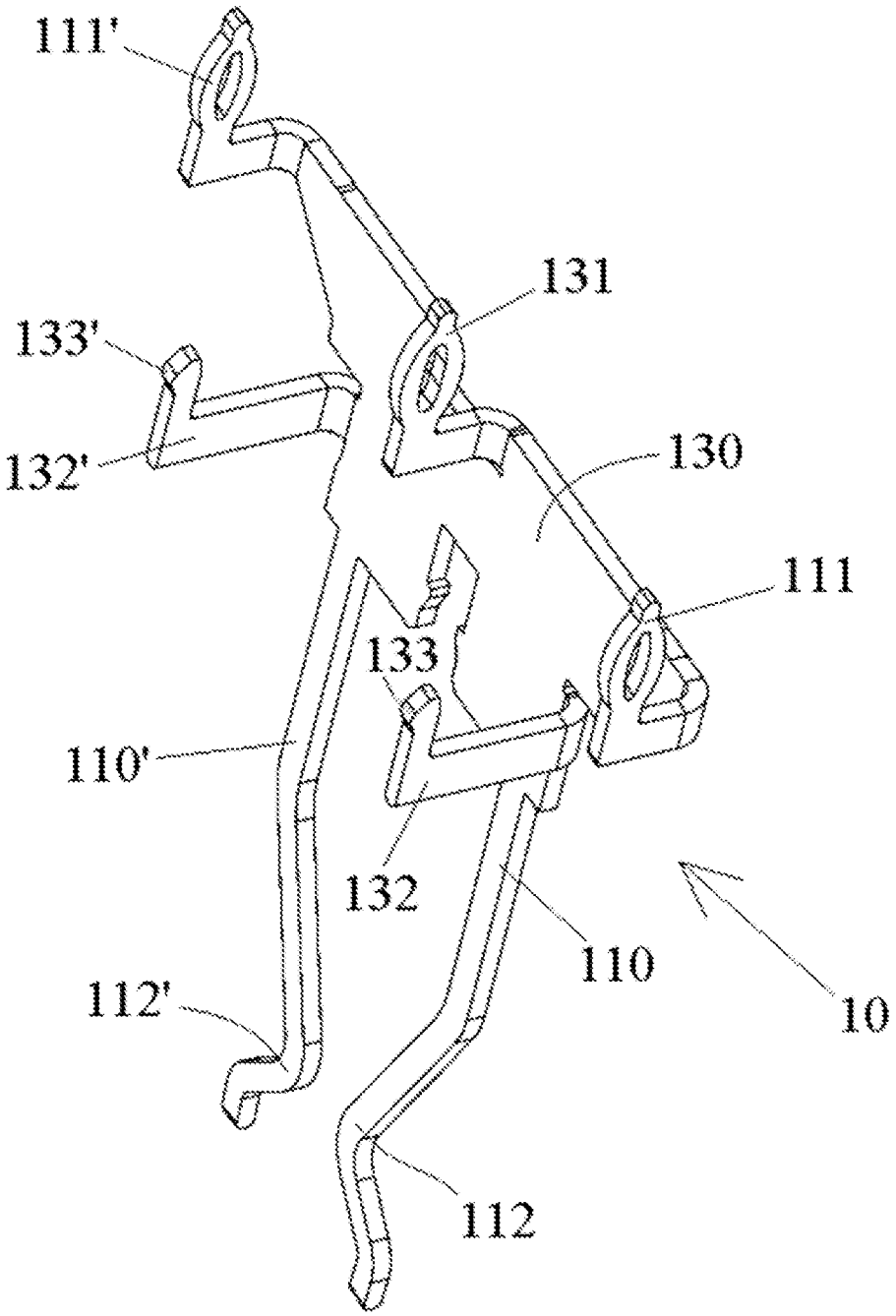
FIG. 4 is an enlarged view of a ground terminal unit of the plurality of ground terminals of FIG. 3.

As is clearly shown in FIGS. 3 and 4, a projecting resilient contact portion 133, 133' is formed on an end of each extension arms 132, 132'; and the resilient contact portion 133, 133' on one of the two adjacent ground terminal units 10 are in electrical contact with the intermediate body portion 130 of the other of the two adjacent ground terminal unit 10.

Proceeding to refer to FIGS. 3 and 4, each ground terminal unit 10 further includes an additional ground terminal pin 131, which is disposed between the pair of ground terminal pins 111, 111'. Thereby, the electrical shield effect of the electrical connector is further enhanced.

As shown in FIGS. 3 and 4, two signal terminal pins 121, 121' are interposed between the additional ground terminal pin 131 and one of the ground terminal pins 111, 111' of each ground terminal unit 10.

As shown in FIGS. 1-3, the plurality of signal terminal pins 121, 121' on both sides of the slot are arranged in two rows along a length of the insulating body 100. The plurality of ground terminal pins 111, 111' on both sides of the slot are arranged in a row along the length of the insulating body 100; and the additional ground terminal pin 131 are arranged in a row along the length of the insulating body 100.

In an exemplary embodiment of the invention, each of the ground terminal units 10 may be formed by folding a single sheet of material. Thereby, the plurality of signal terminals 120, 120' and the plurality of ground terminals 110 may be directly inserted and installed into the insulating body 100.

As shown in FIGS. 1-4, in the shown embodiment, all of the ground terminal pins 111, 111', the signal terminal pins 121, 121', and additional ground terminal pins 131 are to be inserted or welded onto a circuit board (not shown), and all of the electrical contact portions 112, 112', 122 and 122' are adapted to electrically contact the gold fingers (i.e., bonding finger) provided on both front face and back face of an electronic card module (not shown) which is inserted into the slot of the electrical connector.

Figure 5:
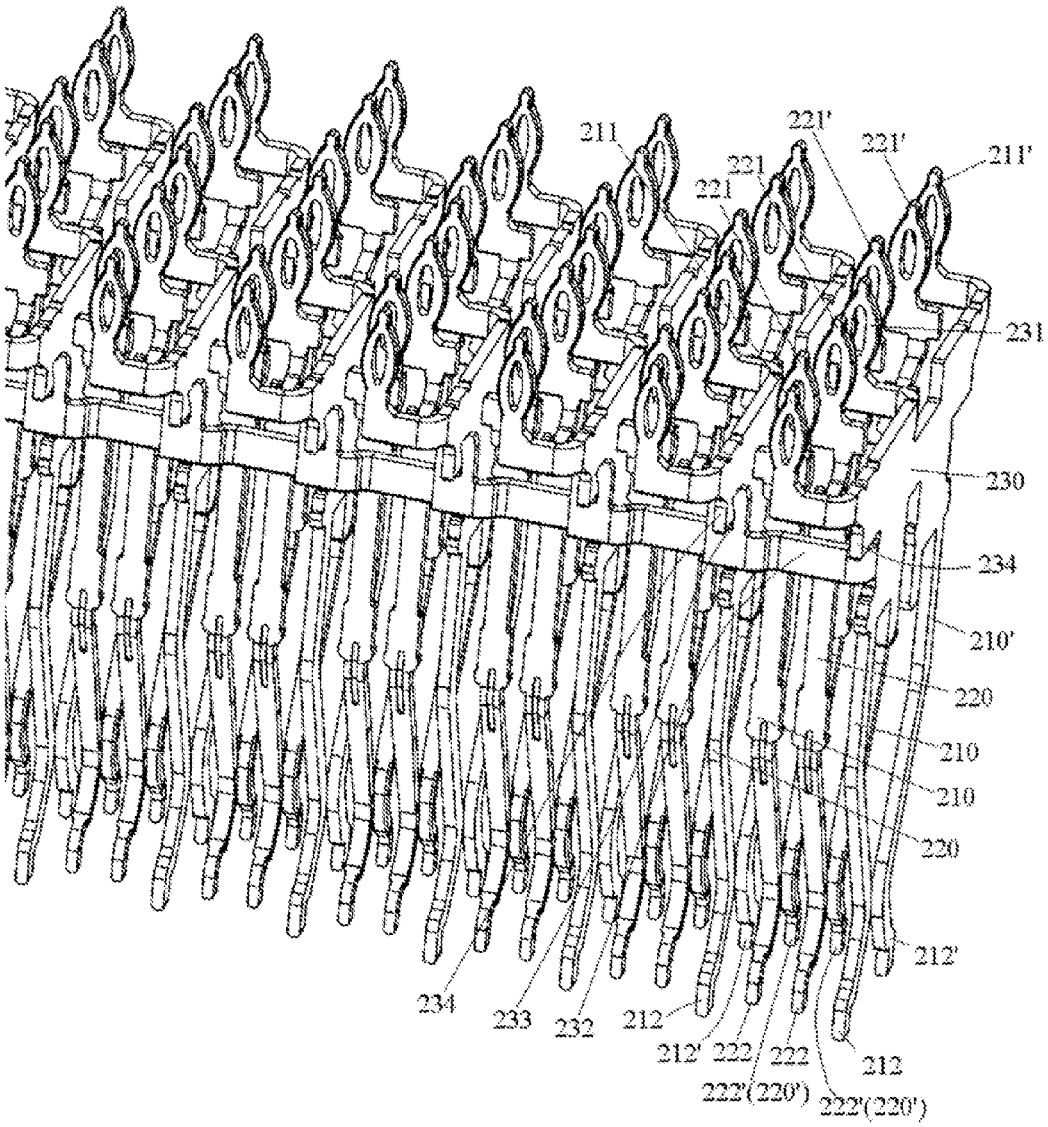
FIG. 5 is an enlarged view of both a plurality of signal terminals and a plurality of ground terminals of another electrical connector according to the invention.
Figure 6:
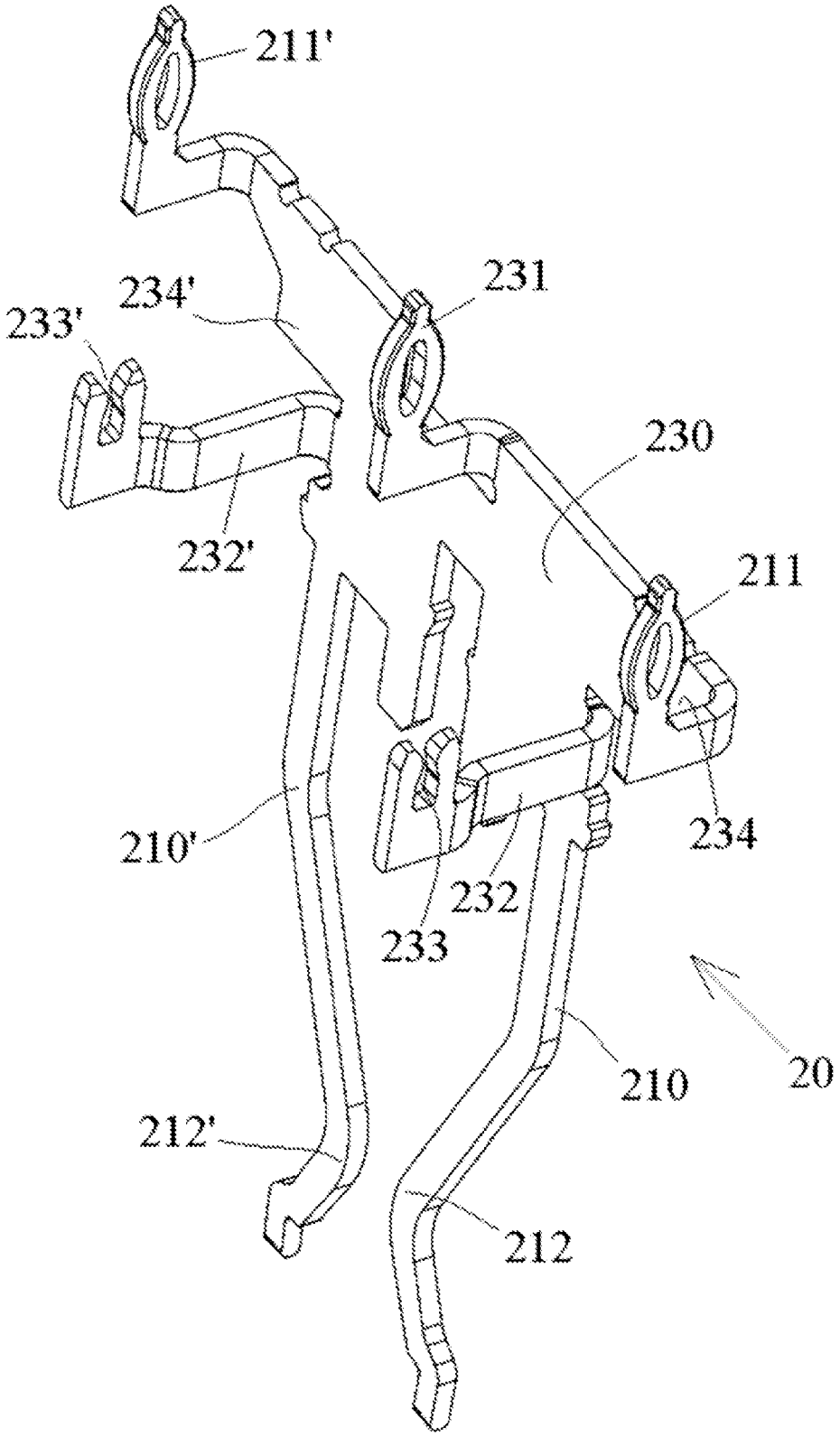
FIG. 6 is an enlarged view of a ground terminal unit of the plurality of ground terminals of FIG. 5.

Now with reference to FIGS. 5 and 6, a plurality of signal terminals 220, 220' and a plurality of ground terminals 210, 210' of another electrical connector according to the invention is shown. As compared with the electrical connector shown in FIGS. 1-4, the electrical connector shown in FIGS. 5 and 6 differ in that, its construction of electrical connection between two adjacent ground terminal units 20 differs from that of the electrical connector of FIGS. 1-4.

As shown in FIGS. 5 and 6, a groove 233, 233' is formed on the end of each extension arm 132, 132', and a flange 234, 234' engaged with the groove is formed on both sides of the intermediate body portion 130.

As shown in FIGS. 5 and 6, the flanges 234, 234' on one of the two adjacent ground terminal units 20 are clamped into the grooves 233, 233' of the other of the two adjacent ground terminal units 20, respectively, so that the two adjacent ground terminal units 20 are electrically connected with each other.

In addition to aforementioned depiction, the electrical connector shown in FIGS. 5 and 6 may be deemed as essentially identical to that of the electrical connector shown in FIGS. 1-4. Therefore, those identical contents are omitted herein for brevity.

It should be appreciated for those skilled in this art that the above embodiments are intended to be shown, and not restrictive. For example, many modifications may be made to the above embodiments by those skilled in this art, and various features described in different embodiments may be freely combined with each other without conflicting in configuration or principle.

Although the disclosure is described in view of the attached drawings, the embodiments disclosed in the drawings are only intended to illustrate the preferable embodiment of the invention exemplarily, and should not be deemed as a restriction thereof.

Although several exemplary embodiments of the general concept of the invention have been shown and described, it would be appreciated by those skilled in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding plural of the elements or steps, unless such exclusion is explicitly stated. Furthermore, references to "one embodiment" of the invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. An electrical connector, comprising:

an insulating body having a slot;

a plurality of signal terminals positioned in the insulating body and configured in pairs along a width of the slot to form a plurality of signal terminal units, each signal terminal unit having a pair of signal contact portions positioned opposite each other with respect to the slot and a pair of signal terminal pins positioned opposite the pair of signal contact portions; and a plurality of ground terminals positioned in the insulating body and configured in pairs along the width of the slot as a plurality of ground terminal units, each ground terminal unit having:

a pair of ground contact portions located on opposite sides of the slot and arranged sequentially in alternation with the pair of signal contact portions along a length of the slot; and a pair of ground terminal pins positioned opposite the pair of ground contact portions.

2. The electrical connector according to claim 1, wherein each ground terminal unit includes a pair of extension arms positioned on both sides of the slot and extending along the length of the slot.

3. The electrical connector according to claim 2, wherein the plurality of ground terminals of the ground terminal unit are connected to each other by an intermediate body portion extending along the width of the slot.

4. The electrical connector according to claim 3, wherein the plurality of ground terminals of the ground terminal unit are integrally connected with the pair of extension arms by the intermediate body portion.

5. The electrical connector according to claim 4, wherein the intermediate body portion is plate shaped.

6. The electrical connector according to claim 4, further comprising a resilient contact portion disposed on an end of each extension arm of the pair of extension arms.

7. The electrical connector according to claim 6, wherein the resilient contact portion on one of a pair of adjacent ground terminal units is connected with the intermediate body portion of the other of the pair of adjacent ground terminal units.

8. The electrical connector according to claim 4, further comprising a groove disposed on an end of each extension arm of the pair of extension arms.

9. The electrical connector according to claim 8, further comprising a pair of flanges disposed on opposite sides of the intermediate body portion.

10. The electrical connector according to claim 9, wherein one flange of the pair of flanges on one of a pair of adjacent ground terminal units is clamped onto the groove of the other of the pair of adjacent ground terminal units.

11. The electrical connector according to claim 4, wherein the ground terminal unit further includes an additional ground terminal pin disposed between the pair of ground terminal pins.

12. The electrical connector according to claim 11, wherein the pair of signal terminal pins are interposed between the additional ground terminal pin and one of the pair of ground terminal pins.

13. The electrical connector according to claim 12, wherein the pair of signal terminal pins on both sides of the slot are arranged in two rows along the length of the insulating body.

14. The electrical connector according to claim 1, wherein the pair of ground terminal pins are positioned on both sides of the slot and arranged in a row along a length of the insulating body.

15. The electrical connector according to claim 1, wherein each ground terminal unit is formed by folding a single sheet of material.

16. The electrical connector according to claim 1, wherein the plurality of signal terminals and the plurality of ground terminals are inserted into the insulting body.

* * * * *